US006914392B2

(12) United States Patent
Hanisch et al.

(10) Patent No.: US 6,914,392 B2
(45) Date of Patent: Jul. 5, 2005

(54) SWITCHING APPARATUS FOR OPERATING DISCHARGE LAMPS

(75) Inventors: Thomas Hanisch, Dresden (DE); Igor Kartashev, Deutschlandsberg (AT); Arnulf Rupp, Taufkirchen (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 62 days.

(21) Appl. No.: 10/610,647

(22) Filed: Jul. 2, 2003

(65) Prior Publication Data

US 2004/0051480 A1 Mar. 18, 2004

(30) Foreign Application Priority Data

Jul. 23, 2002 (DE) ..... 102 33 400

(51) Int. Cl.[7] ..... H05B 37/02; H05B 41/24

(52) U.S. Cl. ..... 315/246; 315/276; 315/225; 315/209

(58) Field of Search ..... 315/246, 276, 315/282, 283, 284, 209 R, 212, 224, 225, 219, 307, 287, 291; H05B 37/02, 41/24

(56) References Cited

U.S. PATENT DOCUMENTS 3,407,334 A 10/1968 Attewell ..... 315/278
3,963,958 A 6/1976 Nuckolls ..... 315/276
4,503,359 A * 3/1985 Watanabe et al. ..... 315/105
5,488,269 A * 1/1996 El-Hamamsy et al. ..... 315/307
5,767,631 A * 6/1998 Konopka et al. ..... 315/307
5,834,907 A 11/1998 Takehara ..... 315/307
5,856,728 A * 1/1999 Zimnicki et al. ..... 315/209 PZ
5,962,988 A * 10/1999 Nuckolls et al. ..... 315/291
6,166,492 A 12/2000 Nuckolls ..... 315/205

FOREIGN PATENT DOCUMENTS

DE 43 10 950 A1 11/1993
GB 2 104 319 A 3/1993

* cited by examiner

*Primary Examiner*—Trinh Vo Dinh

(57) ABSTRACT

The following circuit is proposed for discharge lamps having a particularly high starting voltage. An a.c. voltage generator (1) provides a corresponding a.c. voltage. A starting voltage generating device, which comprises a piezo transformer (2), is connected to the a.c. voltage generator (1) and can be connected at its output to a discharge lamp (4), generates a starting voltage from the a.c. voltage. The starting voltage generating device in this case comprises at least one diode (3) which is connected in parallel with the output of the starting voltage generating device. A zero-order pump circuit is thus integrated in the starting circuit. Advantageous here is the use of higher-order pump circuits.

2 Claims, 6 Drawing Sheets

SWITCHING APPARATUS FOR OPERATING DISCHARGE LAMPS

TECHNICAL FIELD

The invention relates to a switching apparatus for operating a discharge lamp having an a.c. voltage generator or pickup device for providing an a.c. voltage, and a starting voltage generating device, which is connected to the a.c. voltage generator or pickup device and can be connected at its output to the discharge lamp, for generating a starting voltage from the a.c. voltage. Furthermore, the present invention relates to a corresponding method for operating a discharge lamp.

BACKGROUND ART

For operating a gas discharge lamp, a high voltage must first be applied to the lamp in order to start the discharge process of the gas in the lamp. A continuous operating voltage must then be applied to the electrodes of the lamp. For this purpose, it is possible to use either an electrical power supply unit or a switching apparatus which can effect both the starting operation and the operating state, or else two separate voltage sources, one of which being used for starting and the other for operation. A voltage source which can be used for both states must be able to generate the high starting voltage and then be able to function continuously with high efficiency during operation.

Until, now, either superimposed-pulse ignitors or resonant circuits have been used to start discharge lamps. However, these present the following disadvantages in the case of discharge lamps having a particularly high starting voltage:

In the case of a superimposed-pulse ignitor, the operating frequency for continuous operation of the lamp has an upper limit due to the lamp's inductance. This is a substantial restriction, particularly in the case of high-pressure lamps which can be operated only in certain frequency ranges due to the acoustic resonances occurring. Superimposed-pulse ignitors are also comparatively expensive due to the windings, switch elements (for example spark gaps) and capacitors which are required.

In a series resonant circuit, a very high Q factor is required to start discharge lamps having a particularly high starting voltage by increasing the voltage, and hence costs are correspondingly high. The circuit complexity required to reliably attain the resonant frequency in such a resonant circuit is considerable. With series resonant circuits, too, the inductance limits the operating frequency for continuous operation of the lamp. It is therefore possible to use cost-effective operating equipment at high frequency to only a very restricted extent.

DESCLOSURE OF THE INVENTION

The object of the present invention is to propose a switching apparatus and a method which enable cost-effective operation of a discharge lamp having a high starting voltage.

This object is achieved according to the invention by means of a switching apparatus for operating a discharge lamp having an a.c. voltage generator or pickup device for providing an a.c. voltage, and a starting voltage generating device, which is connected to the a.c. voltage generator or pickup device and can be connected at its output to the discharge lamp, for generating a starting voltage from the a.c. voltage, the starting voltage generating device comprising at least one diode which is connected in parallel with the output of the starting voltage generating device.

The abovementioned object is further achieved by a method for operating a discharge lamp by providing an a.c. voltage and generating a starting voltage from the a.c. voltage, the starting voltage being generated by means of a diode which is arranged in parallel with the discharge lamp.

The diode which is connected in parallel with the output of the starting voltage generating device or the discharge lamp, together with the output capacitance of the a.c. voltage generator, serves the purpose of increasing the voltage amplitude according to the action of a pump circuit. With regard to a cascade pump circuit, the described circuit would correspond to a zero-order pump circuit.

The starting voltage generating device therefore preferably comprises a first- or higher-order cascade circuit in series with the diode as a voltage pump circuit. With cascade circuits of this kind correspondingly high voltage rises can be achieved depending on the level of their order, and this is ultimately limited by the Q factor of the components used or their inherent losses and the time constant which increases as the order increases.

In the cascade circuit, in particular two capacitors and two diodes are provided, interconnected in a known manner, per order. It is thus possible for an effective voltage rise to be achieved using comparatively inexpensive components.

In an advantageous manner, an inductor coil is connected between the output of the starting voltage generating device and the diode, i.e. upstream of the discharge lamp, for the purpose of limiting the current. It is thus possible for a current, which would be produced by the reduction in the resistance of the discharge lamp after the starting operation, to be limited.

A switch-off unit is preferably introduced, in series with the diode, for the purpose of switching-off the pumping of the voltage after the starting operation. This switch-off unit unit may be realized in a cost-effective manner by a Zener diode or TVS diode (transient voltage suppressor). The rated voltage of this Zener diode or TVS diode should in this case be greater than the burning voltage of the discharge lamp in order not to impede, or even to prevent, the burning operation.

In an advantageous refinement of the switching apparatus, the starting voltage generating device comprises a piezo transformer. This may be used to achieve high voltage transformation with a small overall size.

Alternatively, however, it is also possible to use a conventional a.c. voltage source, for example a half bridge having a coupling capacitor, for generating the supply voltage.

The circuit topology according to the invention thus permits cost-effective operation of discharge lamps having a high starting voltage, such as, for example, in the case of high-pressure discharge lamps for automobile headlights.

BRIEF DESCRIPTION OF THE DRAWINGS

The present invention will now be explained in more detail with reference to the attached drawings, in which.

BEST MODE FOR CARRYING OUT THE INVENTION

The exemplary embodiments described below are only preferred embodiments of the present invention. In accordance with a first embodiment of the present invention, shown in FIG. 1, a transformer 2 is connected to the output of an a.c. voltage supply circuit 1. The output terminals of the transformer 2 are connected to the electrodes of a gas discharge lamp 4. A diode 3 is connected between the electrodes of the gas discharge lamp.

Figure 1:
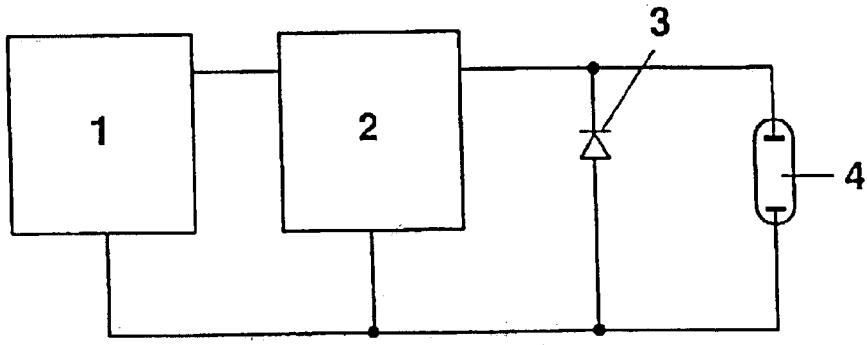
FIG. 1 shows an outline circuit diagram of the switching apparatus according to the invention.
Figure 6:
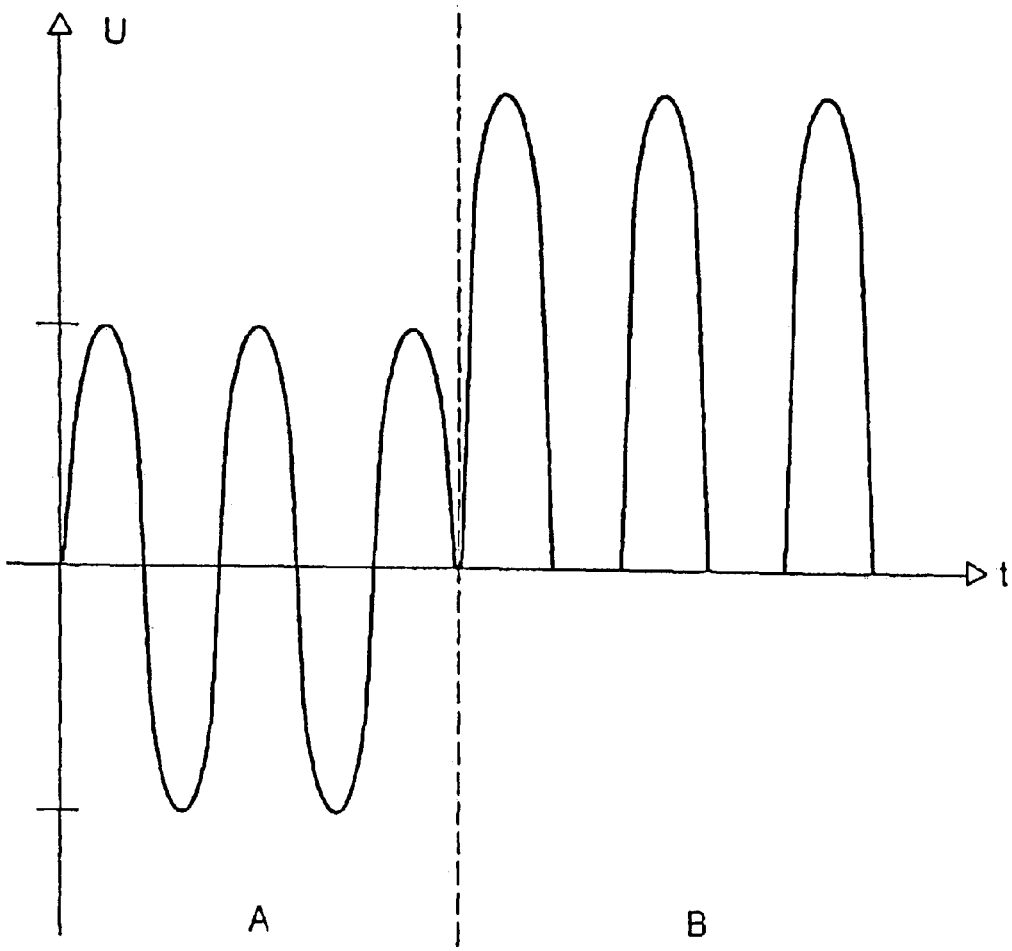
FIG. 6 shows the characteristic of the voltage across the electrodes of a gas discharge lamp without (A) and with a diode (B) prior to starting.

The mode of operation of the circuit in accordance with FIG. 1 can be seen from the voltage characteristic shown in FIG. 6. The a.c. voltage across the electrodes of the gas discharge lamp has, without the diode 3, the sinusoidal voltage characteristic in region A of FIG. 6. The diode 3 connected in parallel with the electrodes of the gas discharge lamp 4 raises the a.c. voltage to a positive value or lowers it to a negative value, with the result that the voltage amplitude is doubled. Depending on the type of discharge lamp, this doubled voltage amplitude is sufficient to start the lamp.

Figure 2:
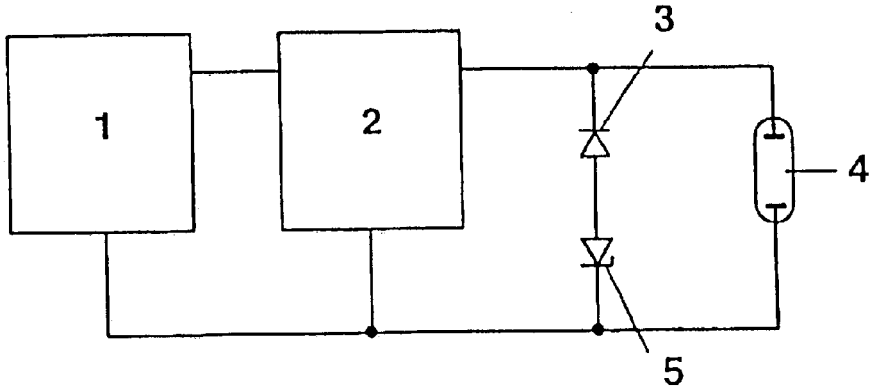
FIG. 2 shows an outline circuit diagram of another embodiment of the present invention.
Figure 3:
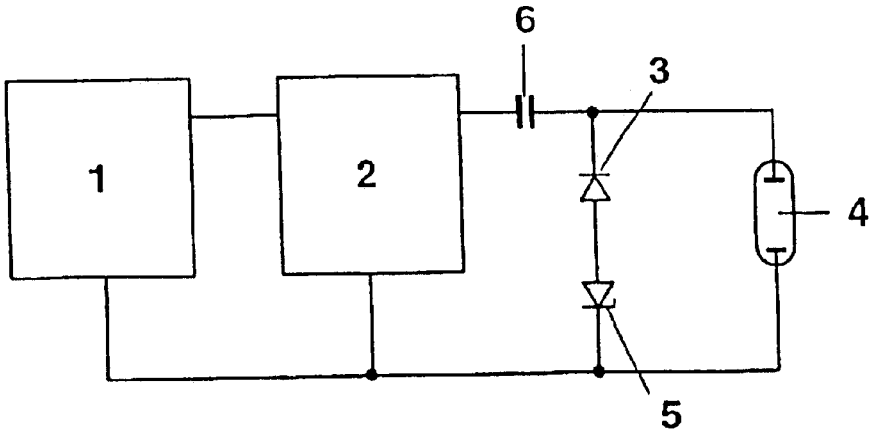
FIG. 3 shows an outline circuit diagram of a further embodiment of the present invention.

FIGS. 2 and 3 show alternative embodiments to that of FIG. 1. The same switch elements or components 1 to 4 are used in each case. In addition, in the circuit in FIG. 2, a switch-off unit or a trigger 5 is connected in series with the diode 3. In this case, this diode 3 is a Zener diode. Alternatively, it is also possible for a unidirectional TVS diode to be used. In this case, the Zener diode is connected as a trigger 5 in the opposite direction to the diode 3. The diode 5 causes the pump circuit to be switched-off after breakdown of the lamp, in which case the rated voltage of the diode, i.e. the Zener voltage, has to be at least as large as the maximum burning voltage of the lamp. The series circuit of the Zener diode as a switch-off element switches the pumping function of the zero-order pump circuit which consists exclusively of the diode 3. Higher-order pump circuits are described in relation to FIG. 8.

The circuit shown in FIG. 3 has essentially the same components as that in FIG. 2. The transformer 2 in the circuit in FIG. 3 is an electromagnetic transformer. The secondary-side coil is used at the same time as a resonance coil for resonant operation. A coupling capacitor 6 is connected in series with the secondary coil and is charged by the pump circuit. This resonant circuit enables very effective operation of the electrical power supply circuit or the gas discharge lamp. Before starting the lamp, the circuit is operated off-load and the output voltage of the resonance transformer is at its highest, with the result that the lamp can be started. After starting, if the lamp is in operation, its internal resistance is reduced, which in turn causes a reduction in the output voltage of the resonance transformer due to it being set off-resonance, with the result that the gas discharge lamp can be operated at a lower voltage value, specific to the lamp type, with high efficiency. This voltage value must be less than the value of the forward voltage of the diode 3. If this, is not the case, the voltage applied to the lamp 4 is limited to the forward voltage of the diode 3.

Figure 4:
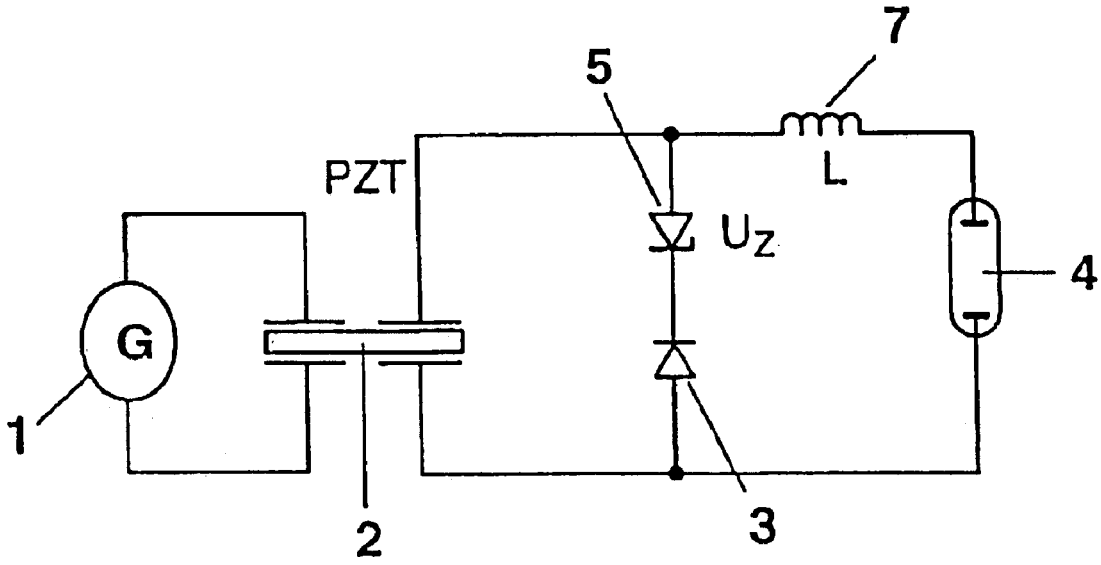
FIG. 4 shows a circuit diagram of a further embodiment of the present invention.

FIG. 4 shows a specific implementation of the embodiment shown in FIG. 2. The transformer 2 is configured as a piezo transformer. On the primary side, the a.c. voltage supplied by the a.c. voltage supply or the generator 1 is converted by the piezoelectric element into mechanical vibrations. These mechanical vibrations converted by the piezoelectric element are converted back into electrical signals on the secondary side. If the piezo element is at mechanical resonance, a corresponding magnification factor of the secondary voltage results. This voltage is increased again by means of the pump circuit having the diodes 3 and 5, with the result that the starting voltage of the lamp 4 is achieved. When starting and during operation of the gas discharge lamp, the lamp has a very low resistance value, with the result that the current has to be limited, if necessary, by an inductor coil 7. The generator 1 for generating the primary-side a.c. voltage can in this case be a half bridge.

Figure 5:
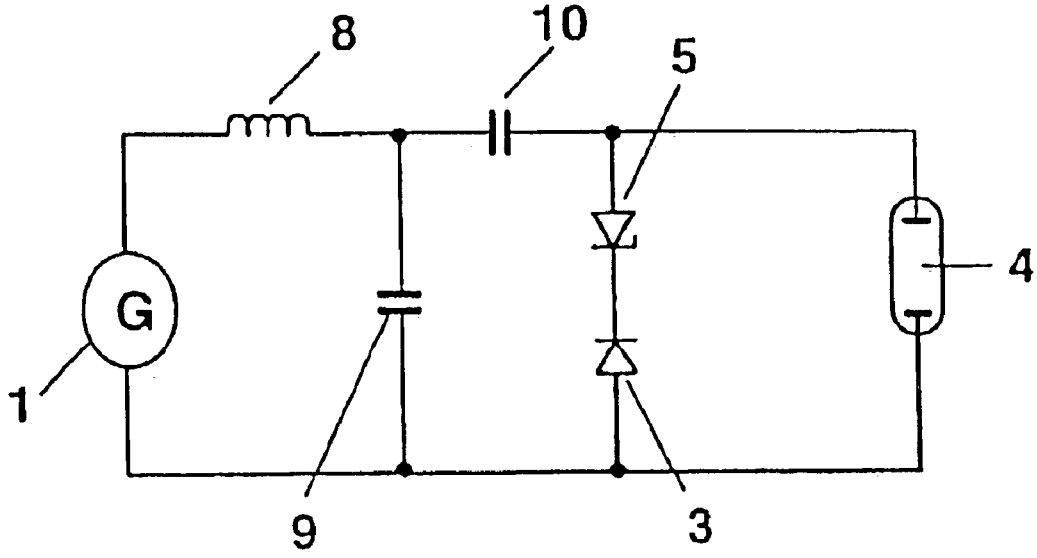
FIG. 5 shows a circuit diagram of yet a further embodiment of the present invention.

FIG. 5 shows a further embodiment of the circuit in accordance with the present invention. The a.c. voltage generated by the generator 1 is applied to a series resonant circuit comprising a resonance coil 8 and a resonance capacitor 9. The voltage across the resonance capacitor 9 is coupled to the lamp 4 via a coupling capacitor 10. The pump circuit having the diodes 3 and 5, as already described in relation to the preceding figures, is connected in parallel with the lamp 4. The coupling capacitor 10, in order to avoid electrophoresis across the electrodes of the gas discharge lamp 4, should have a sufficiently high capacitance for the so-called transfer, i.e. the transition from the glow discharge to the arc discharge. If required, the coupling capacitor 10 can be provided downstream of a series resonance, if necessary having a low Q factor, in order to achieve higher voltages.

Region A in FIG. 6 shows the signal waveform of the a.c. voltage at the output of the transformer which would be present at the discharge lamp 4 if the diode 3 were not present. Region B in FIG. 6 shows the signal waveform produced across the discharge lamp 4 by the diode 3. Thus, the amplitude of the voltage across the electrodes of the discharge lamp 4 is doubled. The diode 3 can thus be considered as a zero-order pump circuit, as already mentioned.

Figure 7:
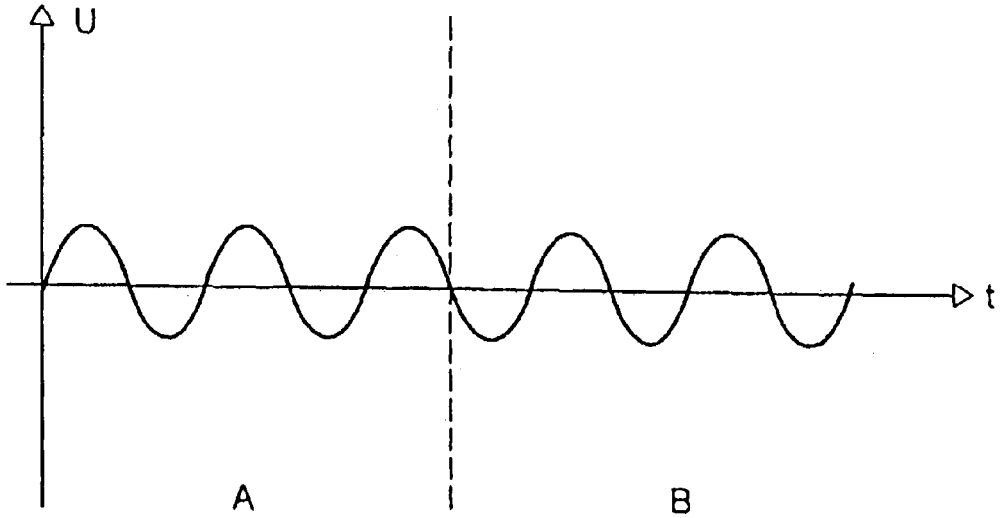
FIG. 7 shows the characteristic of the voltage across the electrodes of a gas discharge lamp without (A) and with a diode (B) during the burning phase.

FIG. 7 shows the characteristic of the a.c. voltage after starting of the discharge lamp, i.e. during the burning phase. It can clearly be seen that the amplitude of the a.c. voltage is reduced compared with that of FIG. 6. The reason for this is that the discharge lamp 4, once started, has a significantly lower resistance, with the- result that the voltage across it is reduced in the burning phase. Furthermore, it can be seen from FIG. 7 that the pump circuit, i.e. the diode 3, is ineffective during the burning phase, since the signal characteristic in region A, i.e. with the diode 3 switched off, is identical to the signal characteristic in region B, i.e. with the diode 3 connected. The reason for this is the Zener diode 5 which switches off the pump circuit after breakdown of the lamp in continuous operation.

Figure 8:
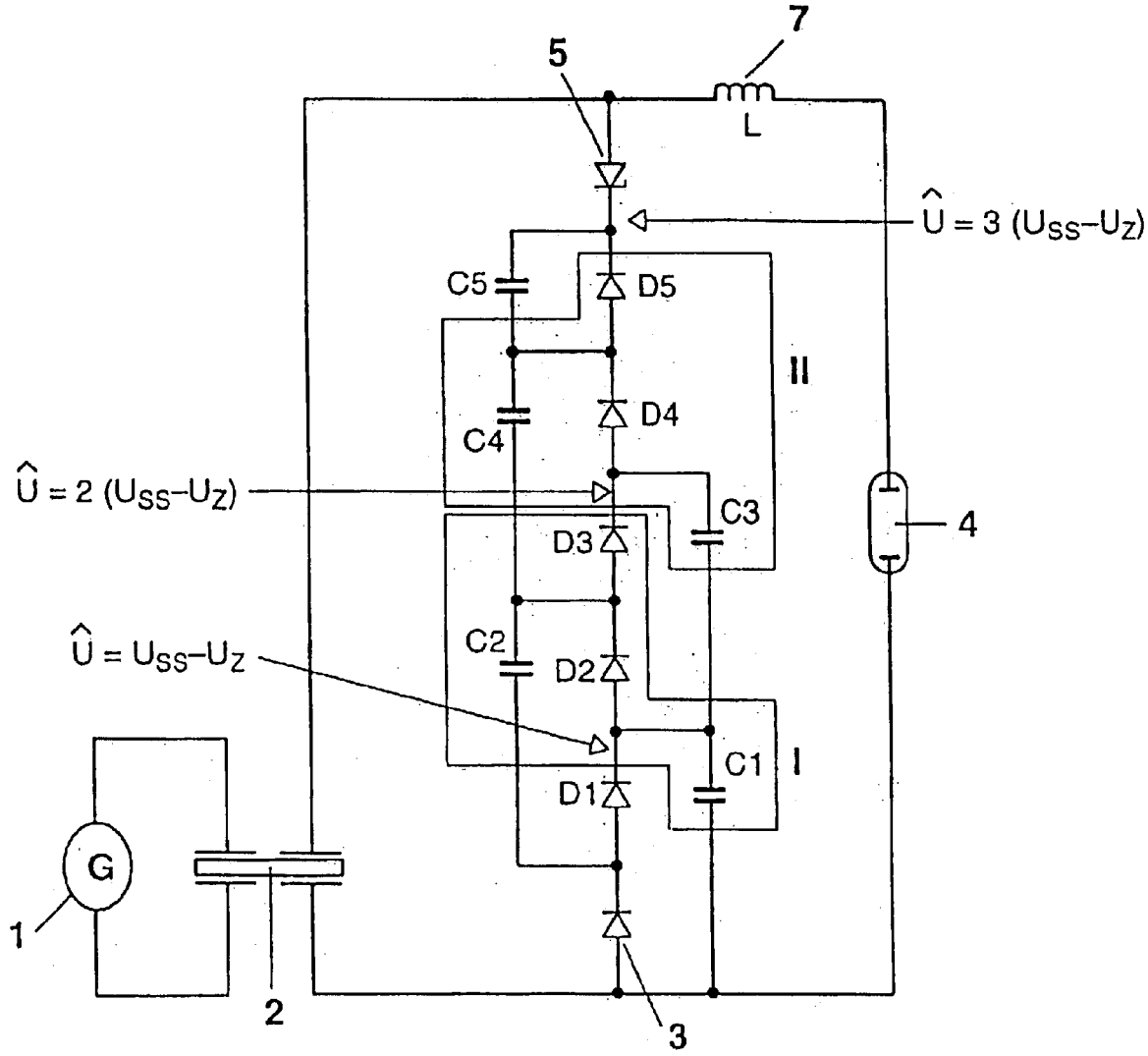
FIG. 8 shows a circuit diagram of a preferred embodiment of the present invention.

FIG. 8 shows a variant of the embodiment in FIG. 4. Instead of the zero-order pump circuit in FIG. 4, the circuit in FIG. 8 is a second-order pump circuit. This means that a cascade circuit of diodes and capacitors is connected between the diode 3 and the Zener diode 5. In a specific case, the diodes D1 to D5 are connected in series between the diode 3 and the Zener diode 5. A capacitor C1 is located in parallel with the diodes 3 and D1, a capacitor C2 is located in parallel with the diodes D1 and D2, a capacitor C3 is located in parallel with the diodes D2 and D3, a capacitor C4 is located in parallel with the diodes D3 and D4 and a capacitor C5 is located in parallel with the diode D5. The components in one stage of the cascade are characterized by the regions I and II in FIG. 8.

The zero-order cascade produces a peak voltage $\hat{U}=U_{SS}-U_Z$. After the first stage of the cascade, i.e. of the first-order pump circuit, a peak voltage $\hat{U}=2\times(U_{SS}-U_Z)$ is produced. Finally, after the second stage of the cascade circuit, i.e. of the second-order pump circuit, a peak voltage $\hat{U}=3\times(U_{SS}-U_Z)$ is set up. Here, $U_{ss}$ is the peak-to-peak value of the a.c. voltage across the secondary side of the transformer 2, and $U_Z$ is the Zener voltage.

Figure 9:
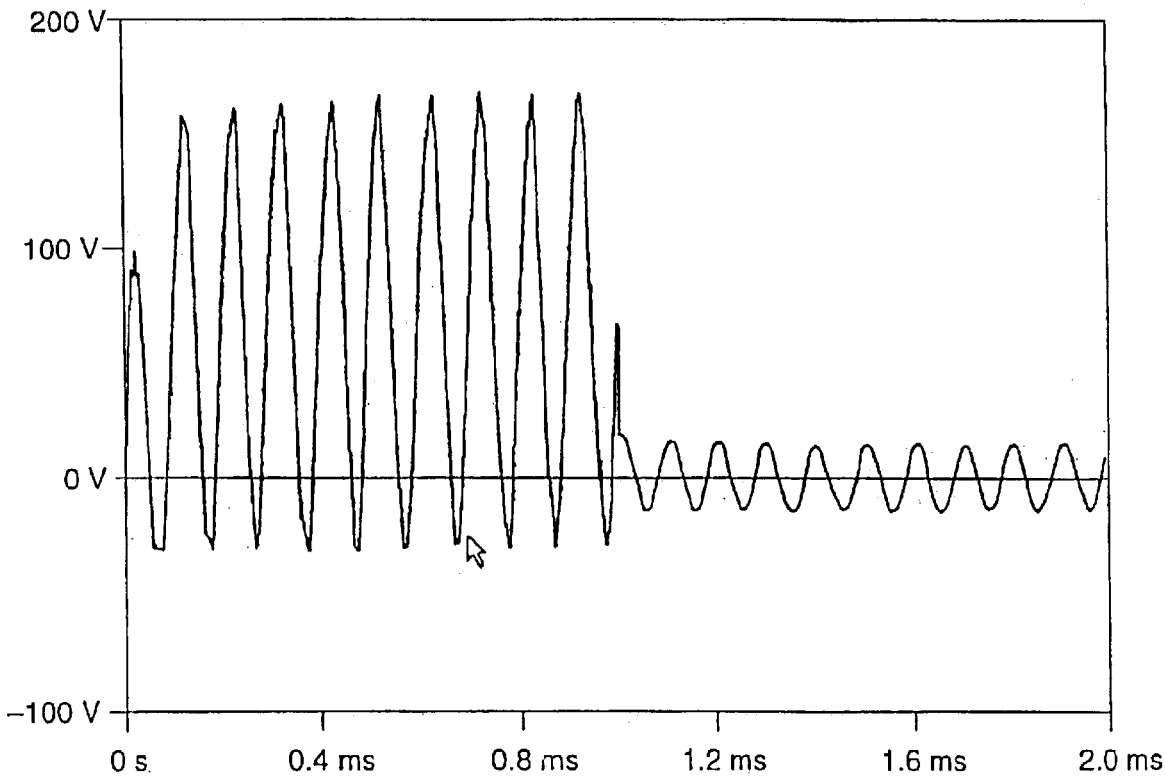
FIG. 9 shows the characteristic of the voltage across the electrodes of a gas discharge lamp resulting due to a zero-order pump circuit according to FIG. 4, prior to starting and after starting.

FIG. 9 shows the characteristic of the voltage across the gas discharge lamp 4 for the embodiments according to the invention in accordance with FIGS. 2 to 5. Once switched on, the final pump voltage is set up very rapidly. After starting, the pumping operation is switched off and the voltage falls to the burning voltage, as already explained in relation to FIGS. 6 and 7.

Figure 10:
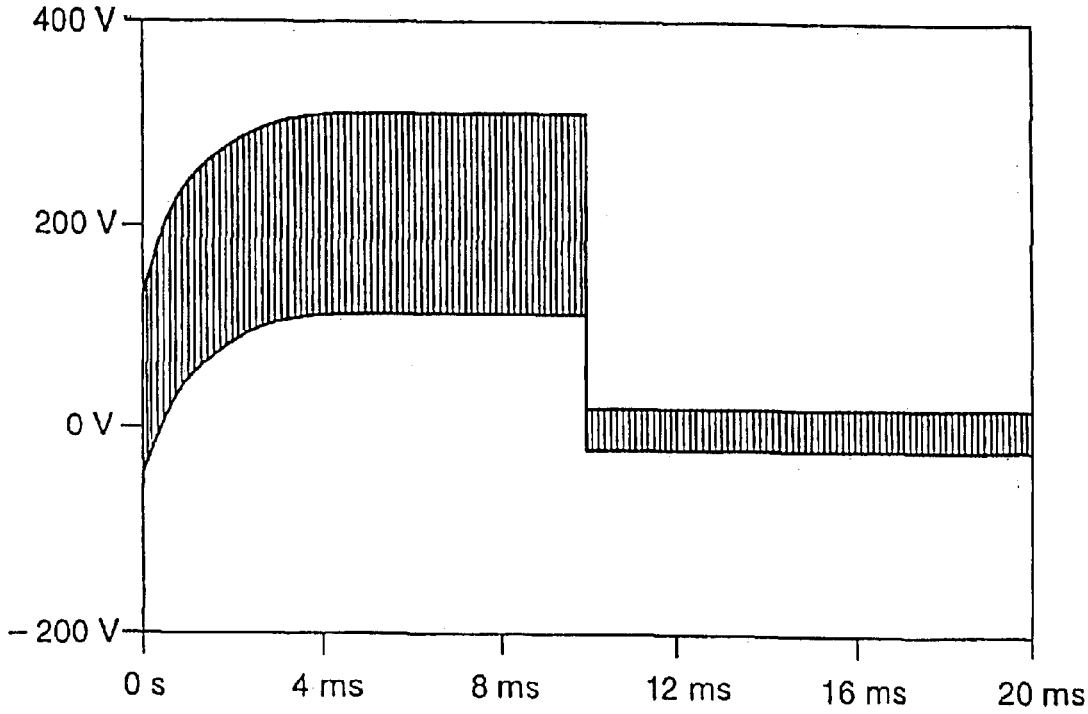
FIG. 10 shows the characteristic of the voltage across the electrodes of a gas discharge lamp resulting due to a second-order pump circuit according to FIG. 8, prior to starting and after starting.

In the case of a second-order pump circuit, shown in FIG. 8, the voltage characteristic depicted in FIG. 10 results. In this case, the a.c. voltage is superimposed by a d.c. voltage and the value of this d.c. voltage is approximately twice as high as compared with the zero-order pump circuit. After approximately 4 ms, the final pump value is achieved. After starting, the pumping phase is also ended and the burning voltage is set up across the lamp as in FIG. 9.

Figure 11:
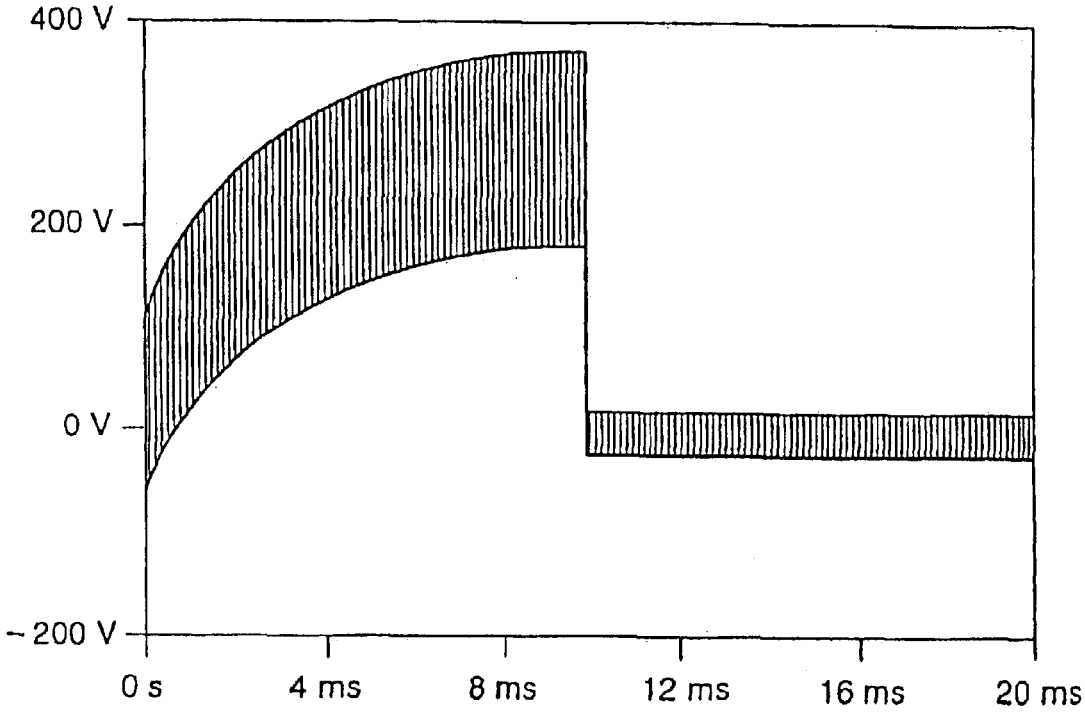
FIG. 11 shows the characteristic of the voltage across the electrodes of a gas discharge lamp resulting due to a third-order pump circuit, prior to starting and after starting.

FIG. 11 shows, finally, the voltage/time characteristic in the case of a third-order cascade circuit. Although the pump voltage which can be achieved is ideally correspondingly higher, the time constant with which this final pump voltage is achieved is likewise considerably higher than in the case of the second-order pump circuit in accordance with FIG. 10. Even after 10 ms, the final pump value is still not achieved in this case. For very high starting voltages, this pumping technology thus reaches its natural limit.

One advantage of the described starting circuit is that, in general, a considerably lower breakdown voltage is required than in the case of pulse ignitors, since the voltage-time area is greater here.

What is claimed is:

1. A switching apparatus for operating a discharge lamp, comprising:

an a.c. voltage generator or pickup device for providing an a.c. voltage; and a starting voltage generating device, which is connected to the a.c. voltage generator or pickup device, for generating a starting voltage from the a.c. voltage, the starting voltage generating device having output for connection to the discharge lamp;

characterized in that:

the starting voltage generating device comprises at least one diode which is connected to the output of the starting voltage generating device;

the starting voltage generating device further comprises a first- or higher-order cascade circuit (D1 to D5, C1 to C5) in series with the doide as a voltage pump circuit; and the cascade circuit (D1 to D5, C1 to C5) has two capacitors and two diodes per order.

2. A switching apparatus for operating a discharge lamp, comprising:

an a.c. voltage generator or pickup device for providing an a.c. voltage; and a starting voltage generating device, which is connected to the a.c. voltage generator or pickup device, for generating a starting voltage from the a.c. voltage, the starting voltage generating device having an output for connection to the discharge lamp;

characterized in that:

the starting voltage generating device comprises at least one diode which is connected to the output of the starting voltage generating device;

the switching apparatus further comprises a switch-off unit, coupled in series with the diode, for switching off the starting voltage for the burning operation of the discharge lamp.

the switch-off unit has a Zener diode or a TVS diode; and the Zener diode has a Zener voltage that is greater than or equal to the maximum burning voltage of the discharge lamp.

* * * * *